US006155863A

United States Patent [19]

Matsuzaki et al.

[11] Patent Number: 6,155,863

[45] Date of Patent: Dec. 5, 2000

[54] ELECTRICAL CONNECTOR FOR MANIPULATION BY A SUCTION APPLYING TOOL

[75] Inventors: Shinichi Matsuzaki, Tokyo; Toshihiro Niitsu, Machida, both of Japan

[73] Assignee: Molex Incorporated, Lisle, Ill.

[21] Appl. No.: 09/457,970

[22] Filed: Dec. 9, 1999

[30] Foreign Application Priority Data

Jan. 28, 1999 [JP] Japan ..... 11-020166

[51] Int. Cl.[7] ..... H01R 13/627

[52] U.S. Cl. ..... 439/353; 439/940

[58] Field of Search ..... 439/135, 587, 439/79, 80, 940, 353, 301

[56] References Cited

U.S. PATENT DOCUMENTS

| | | | |
|---|---|---|---|
| 3,545,606 | 12/1970 | Bennett et al. | 206/56 |
| 4,396,245 | 8/1983 | Lane | 439/148 |
| 4,795,354 | 1/1989 | Owen | 439/137 |
| 4,975,075 | 12/1990 | Jinno et al. | 439/353 |
| 5,055,971 | 10/1991 | Fudala et al. | 361/400 |
| 5,242,311 | 9/1993 | Seong | 439/135 |
| 5,249,977 | 10/1993 | Tanaka et al. | 439/135 |
| 5,277,601 | 1/1994 | Miyazawa | 439/135 |
| 5,361,492 | 11/1994 | Miyazawa | 29/879 |
| 5,383,797 | 1/1995 | Seong et al. | 439/940 |
| 5,487,678 | 1/1996 | Tsuji et al. | 439/353 |
| 5,681,174 | 10/1997 | Correll, Jr. et al. | 439/135 |
| 5,688,133 | 11/1997 | Ikesugi et al. | 439/135 |

*Primary Examiner*—T. C. Patel

*Attorney, Agent, or Firm*—Stephen Z. Weiss

[57] ABSTRACT

An electrical connector is provided for mating with a complementary mating connector and is adapted for manipulation by a vacuum-suction nozzle. The connector includes a housing mounting a plurality of terminals and including a surface area of a size sufficient for engagement by the vacuum-suction nozzle. An opening is provided in the surface area for receiving a portion of the mating connector. A frangible seal hermetically seals the opening to allow the vacuum-suction nozzle to apply negative air pressure to the surface area over the opening. The seal is breakable to allow the portion of the mating connector to enter the opening.

10 Claims, 3 Drawing Sheets

ELECTRICAL CONNECTOR FOR MANIPULATION BY A SUCTION APPLYING TOOL

FIELD OF THE INVENTION

This invention generally relates to the art of electrical connectors and, particularly, to a connector for mating with a complementary mating connector having a latch member, with the connector being adapted for manipulation by a vacuum-suction nozzle.

BACKGROUND OF THE INVENTION

Vacuum transfer and placement mechanisms are well known in the electronic assembly art and are used for retrieving electronic components, such as connectors, from a supply source and transferring them by applying negative air pressure to the connectors and placing them onto a printed circuit board in preselected positions for soldering. Typically, such mechanisms are used with robotic assemblers and include a transfer arm with an engagement end that is pneumatically connected to a source of negative air pressure. This negative air pressure creates a vacuum at a vacuum suction nozzle at the engagement end of the transfer arm which can be used to effectively "grab" a connector so that the connector may be robotically transferred into a placement position with great accuracy onto a circuit board or like component.

After the connector is accurately placed on a circuit board, the terminals of the connector are soldered to circuit traces on the board. The connector then is released from the vacuum-suction nozzle by stopping application of negative pressure thereto. A complementary mating connector then can be mated to the board mounted connector.

With the ever-increasing demand for miniaturized interconnection systems between electronic components, including circuit board mounted connectors, it has been increasingly difficult to provide a surface area on the connector (typically the connector housing) for engagement by a vacuum-suction nozzle. Simply enlarging the connector often is not a viable solution to this problem, because larger connectors take up valuable "real estate" on the circuit board. This problem is further compounded when the surface area of the housing must be used for other functions. For instance, the mating connector may include a latch projection which engages within a latch opening in the housing. The latch opening creates a "window" which prevents the application of negative pressure to the housing in the area of the latch opening. The present invention is directed to solving these problems by providing a unique solution for temporarily closing such openings or windows.

SUMMARY OF THE INVENTION

An object, therefore, of the invention is to provide a new and improved electrical connector adapted for manipulation by a vacuum-suction nozzle.

Another object of the invention is to provide such an electrical connector with a latch opening for receiving a latch member of a complementary mating connector.

In the exemplary embodiment of the invention, the connector includes a housing mounting a plurality of terminals. The housing has a surface area of a size sufficient for engagement by the vacuum-suction nozzle. A latch opening is formed in the surface area for receiving the latch member of the mating connector. Frangible seal means hermetically seal the latch opening to allow the vacuum-suction nozzle to apply negative air pressure to the surface area over the opening. The seal means is breakable to allow the latch member of the mating connector to enter the latch opening.

As disclosed herein, the frangible seal means is provided by a flap extending into the latch opening. A substantial portion of the flap is surrounded by a frangible, hermetically sealing web. The flap is joined to the housing by a hinge such that the flap remains joined to the housing after the frangible sealing web is broken.

The housing preferably is molded of dielectric material such as plastic or the like. The flap which extends into the latch opening is joined to the housing by a living hinge molded integrally therewith. The frangible web which surrounds the flap also is formed by a thin integrally molded membrane.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
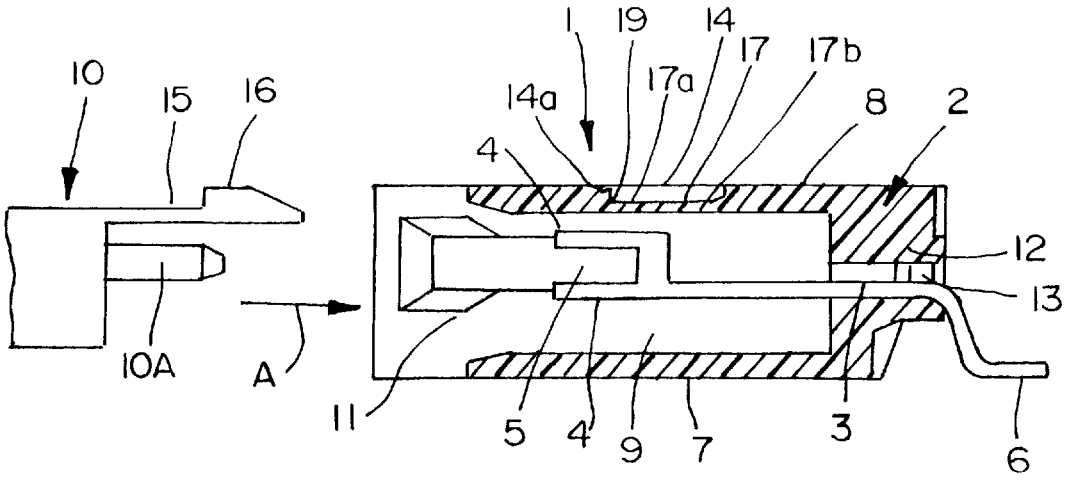
FIG. 1 is a vertical section through the board mounted connector of the invention, in conjunction with a fragmented elevation of a portion of a complementary mating connecter having a latch projection.
Figure 2:
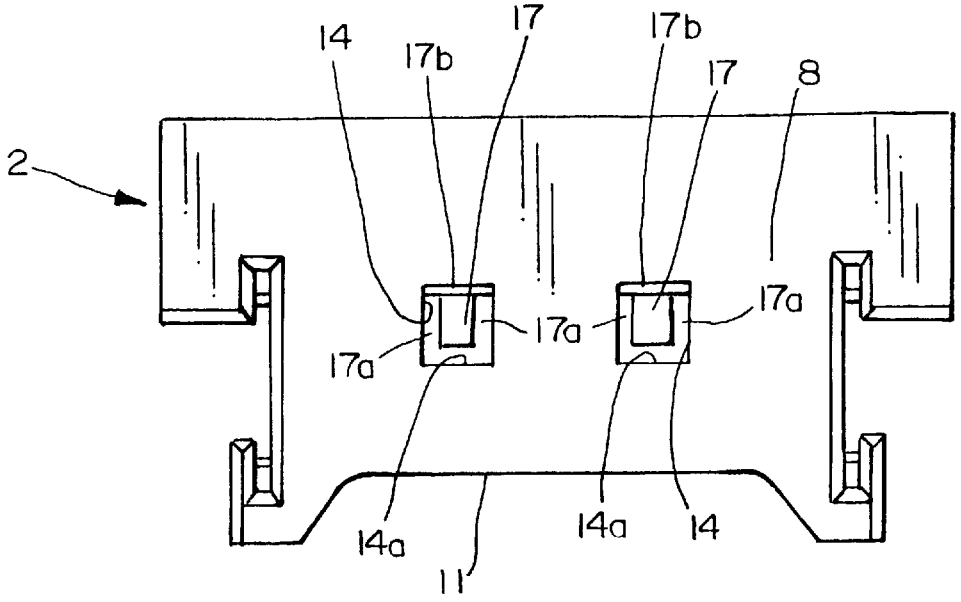
FIG. 2 is top plan view of the board mounted connector housing.
Figure 3:
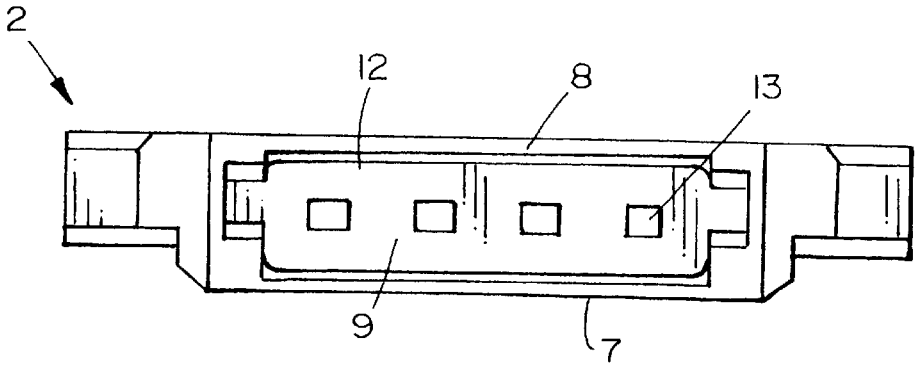
FIG. 3 is a front elevational view of the connector housing.
Figure 4:
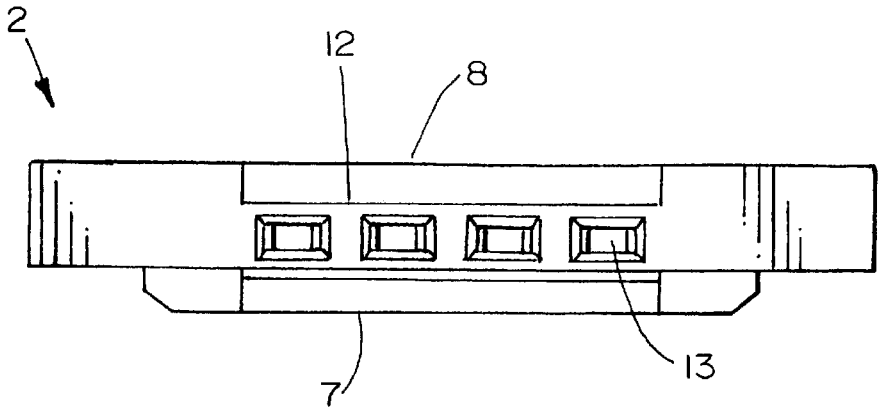
FIG. 4 is a rear elevational view of the connector housing.
Figure 5:
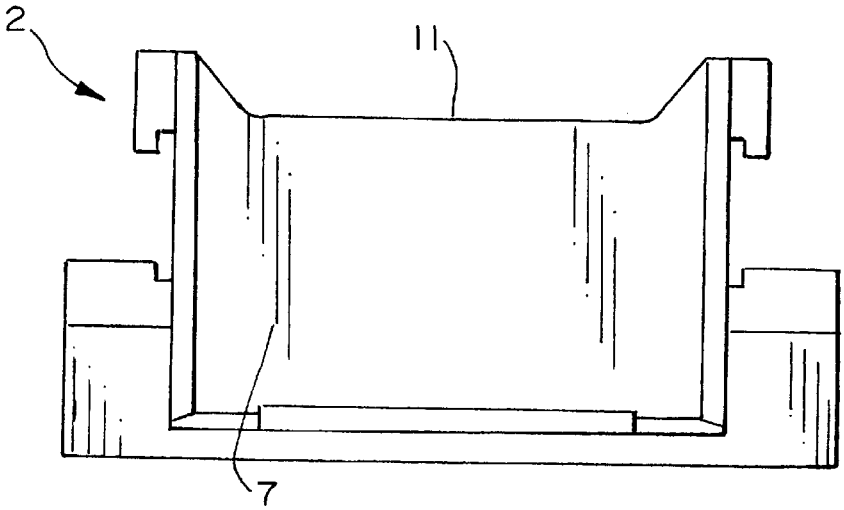
FIG. 5 is a bottom plan view of the connector housing.
Figure 6:
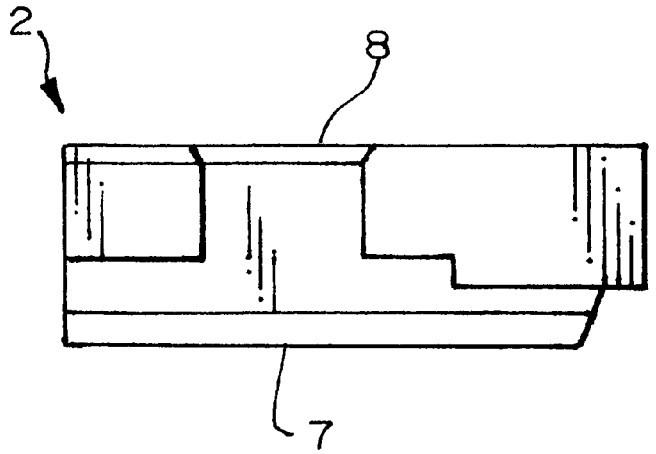
FIG. 6 is a side elevational view of the connector housing.

Referring to the drawings in greater detail, and first to FIG. 1, the invention is embodied in an electrical connector, generally designated 1, which is adapted for mounting on a printed circuit board and which mates with a complementary mating connector, generally designated 10. Board mounted connector 1 also is adapted for manipulation by a vacuum-suction nozzle of a vacuum transfer and placement mechanism. For instance, the mechanism may retrieve the connector from a supply thereof and transfer the connector by applying negative air pressure thereto, and placing the connector on a printed circuit board in a preselected position for soldering the terminals of the connector to the circuit board.

More particularly, board mounted connector 10 includes a dielectric housing, generally designated 2, which is molded of plastic material or the like. The housing mounts a plurality of terminals, generally designated 3. the terminals are stamped and formed of conductive sheet metal material.

Each terminal 3 includes a pair of spaced interior contact portions 4 defining a receptacle 5 for receiving a pin-like terminal 10A of mating connector 10. Each terminal also includes a tail portion 6 projecting out of the rear of housing 2 for soldering to an appropriate circuit trace on the printed circuit board. The tail portions of the terminals are flush with the bottom surface of a bottom wall 7 of housing 2.

Referring to FIGS. 2–6 in conjunction with FIG. 1, molded dielectric housing 2 has a top wall 8 defining a surface area of a size sufficient for engagement by a vacuum-suction nozzle. The housing defines a plurality of terminal-receiving cavities 9, and the housing has a front receptacle 11 for receiving mating connector 10. A rear wall 12 of the housing has a plurality of slots 13 through which the solder tails of the terminals project.

Dielectric housing 2 includes a pair of latch openings 14 having front latching edges 14*a*. Complementary mating connector 10 includes a pair of resiliently flexible latch arms 15 projecting forwardly and terminating in latch members 16. Each latch member has a latch shoulder 16*a*. When mating connector 10 is inserted into receptacle 11 of board-mounted connector 1 in the direction of arrow "A" (FIG. 1), latch members 16 of latch arms 15 snap into latch openings 14 to lock the connectors together. Latch shoulders 16*a* of the mating connector engage behind latching edges 14*a* at the front of latch openings 14 to prevent pulling mating connector 10 back out of board mounted connector 11.

Generally, the invention contemplates the provision of frangible seal means to hermetically seal latch openings 14 to allow the vacuum-suction nozzle to apply negative air pressure to the surface area of top wall 8 even if the vacuum-suction nozzle overlaps one or both of latch openings 14. In particular, referring to FIG. 7 in conjunction with FIGS. 1 and 2, the frangible seal means includes a flap 17 having three chamfered sides 17*a* and a hinge side 17*b*. The three chamfered sides are joined to three sides of latch opening 14 by a frangible, hermetically sealing web 19. This web is in the form of a thin membrane (e.g., 0.02 mm thick) which is easily breakable by latch member 16 of mating connector 10, but which is sufficiently strong to provide an air-tight seal about flap 17 to allow negative air pressure to be applied to top wall 8 of the housing by the vacuum-suction nozzle.

Figure 7:
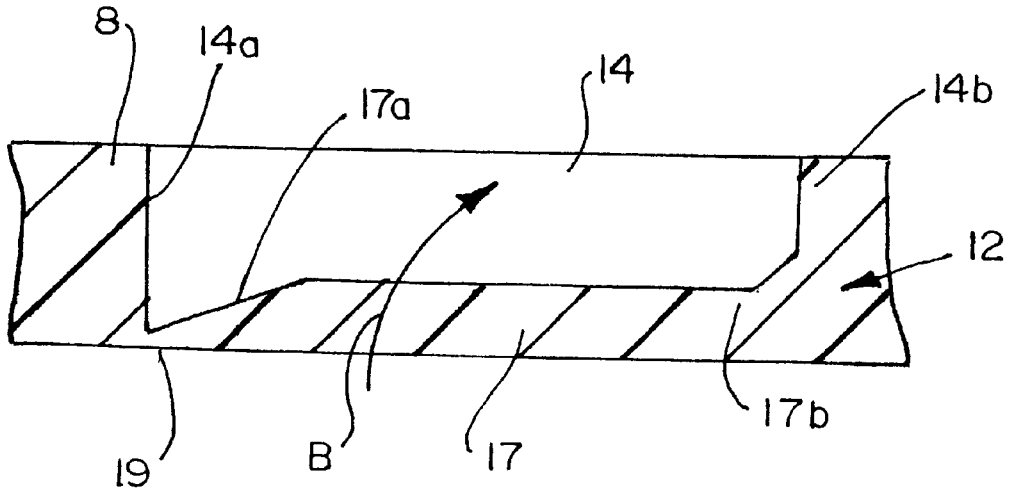
FIG. 7 is an enlarged section through one of the latch openings with the sealing flap still joined to the housing to hermetically seal the opening.

While thin membrane or web 19 surrounds three sides 17*a* of flap 17, the remaining side 17*b* joins the flap to housing 2 to create a living hinge so that the flap can pivot upwardly in the direction of arrow "B" (FIG. 7). When latch member 16 of mating connector 10 breaks web 19 surrounding three sides of flap 17, the flap pivots upwardly about living hinge 17*b* in the direction of arrow "B" so that latch shoulder 16*a* seats behind latching edge 14*a* at the front of latch opening 14. Flap 17 never becomes broken away from the housing and simply is pivoted out of the way to allow for latching of the two connectors. This is important so that flap 17, which is extremely small, does not have to be retrieved after web 19 is broken.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. An electrical connector for mating with a complementary mating connector having a latch member, the electrical connector being adapted for manipulation by a vacuum-suction nozzle, comprising:

a housing mounting a plurality of terminals and including a surface area of a size sufficient for engagement by the vacuum-suction nozzle;

a latch opening in said surface area for receiving the latch member of the mating connector; and frangible seal means hermetically sealing said latch opening to allow the vacuum-suction nozzle to apply negative air pressure to the surface area over the opening, the seal means being breakable to allow said latch member of the mating connector to enter the latch opening.

2. The electrical connector of claim 1 wherein said frangible seal means comprises a flap extending into the latch opening, the flap being surrounded about a substantial portion thereof by a frangible, hermetically sealing web.

3. The electrical connector of claim 2 wherein said flap is joined to the housing by hinge means such that the flap remains joined to the housing after the frangible sealing web is broken.

4. The electrical connector of claim 1 wherein said housing is molded of dielectric material, and said frangible seal means is molded integrally therewith.

5. An electrical connector for mating with a complementary mating connector having a latch member, the electrical connector being adapted for manipulation by a vacuum-suction nozzle, comprising:

a housing mounting a plurality of terminals, the housing being molded of dielectric material and including a surface area of a size sufficient for engagement by the vacuum-suction nozzle;

a latch opening in said surface area for receiving the latch member of the mating connector; and a frangible seal integrally molded with the housing and hermetically sealing said latch opening to allow the vacuum-suction nozzle to apply negative air pressure to the surface area over the opening, the seal being breakable to allow said latch member of the mating connector to enter the latch opening.

6. The electrical connector of claim 5 wherein said frangible seal comprises a flap extending into the latch opening, the flap being surrounded about a substantial portion thereof by a frangible hermetically sealing web molded integrally between the flap and the housing.

7. The electrical connector of claim 6 wherein said flap is joined to the housing by an integrally molded hinge means such that the flap remains joined to the housing after the frangible sealing web is broken.

8. An electrical connector for mating with a complementary mating connector and being adapted for manipulation by a vacuum-suction nozzle, comprising:

a housing mounting a plurality of terminals, the housing being molded of dielectric material and having a surface area of a size sufficient for engagement by the vacuum-suction nozzle;

a window in said surface area for receiving a portion of the mating connector;

a frangible seal hermetically sealing said window to allow the vacuum-suction nozzle to apply negative air pressure to the surface area over the window, the seal being breakable to allow the portion of the mating connector to enter the window.

9. The electrical connector of claim 8 wherein said frangible seal comprises a flap extending into the window, the flap being surrounded about a substantial portion thereof by a frangible hermetically sealing web molded integrally between the flap and the housing.

10. The electrical connector of claim 9 wherein said flap is joined to the housing by an integrally molded hinge means such that the flap remains joined to the housing after the frangible sealing web is broken.

* * * * *